US011328859B2

(12) United States Patent
Lin et al.

(10) Patent No.: US 11,328,859 B2
(45) Date of Patent: May 10, 2022

(54) HIGH ISOLATION INTEGRATED INDUCTOR AND METHOD THEROF

(71) Applicant: Realtek Semiconductor Corp., Hsinchu (TW)

(72) Inventors: Chia-Liang (Leon) Lin, Fremont, CA (US); Chi-Kung Kuan, Fremont, CA (US)

(73) Assignee: REALTEK SEMICONDUCTOR CORP., Hsinchu (TW)

( * ) Notice: Subject to any disclaimer, the term of this patent is extended or adjusted under 35 U.S.C. 154(b) by 715 days.

(21) Appl. No.: 15/856,350

(22) Filed: Dec. 28, 2017

(65) Prior Publication Data

US 2019/0206613 A1 Jul. 4, 2019

(51) Int. Cl.
*H01F 5/00* (2006.01)
*H01F 27/34* (2006.01)
(Continued)

(52) U.S. Cl.
CPC ..... *H01F 27/34* (2013.01); *H01F 17/0013* (2013.01); *H01F 27/2804* (2013.01); *H01F 41/041* (2013.01); *H01F 2027/2809* (2013.01)

(58) Field of Classification Search
CPC ..... H01F 27/2804
(Continued)

(56) References Cited

U.S. PATENT DOCUMENTS 5,525,941 A * 6/1996 Roshen ..... H01F 17/0006 257/E23.178
6,587,025 B2 * 7/2003 Smith ..... H01F 17/0013 336/200
(Continued)

FOREIGN PATENT DOCUMENTS

CN 1497622 A 5/2004
TW 201614799 A 4/2016

OTHER PUBLICATIONS

TIPO Office Action dated Jan. 11, 2019 in Taiwan application (No. 107137275).
(Continued)

*Primary Examiner* — Ronald Hinson
(74) *Attorney, Agent, or Firm* — McClure, Qualey & Rodack, LLP

(57) ABSTRACT

A device comprises: a first spiral coil laid out on a first metal layer of a multi-layer structure, the first spiral coil spiraling inward from a first end to a second end in a clockwise direction from a first perspective that is perpendicular to the first metal layer; a second spiral coil laid out on the first metal layer, the second spiral coil spiraling outward from a third end to a fourth end in a counterclockwise direction from the first perspective, wherein the first spiral coil and the second spiral coil are substantially symmetrical with respect to a central line perpendicular to the multi-layer structure; a twin-spiral coil laid out on a second metal layer of the multi-layer structure, the twin-spiral coil spiraling outward from a fifth end to the central line in a clockwise direction from the first perspective and then spiraling inward from the central line to a sixth end in a counterclockwise direction from the first perspective, wherein the twin-spiral coil is substantially symmetrical with respect to the central line; a first via configured to electrically connect the second end to the fifth end; and a second via configured to electrically connect the third end to the sixth end.

3 Claims, 3 Drawing Sheets

(51) Int. Cl.
*H01F 41/04* (2006.01)
*H01F 27/28* (2006.01)
*H01F 17/00* (2006.01)

(58) Field of Classification Search
USPC ..... 336/200
See application file for complete search history.

(56) References Cited

U.S. PATENT DOCUMENTS

| | | | | |
|---|---|---|---|---|
| 7,106,162 | B2 | 9/2006 | Saito | |
| 9,748,326 | B2 | 8/2017 | Yen et al. | |
| 9,875,961 | B2 | 1/2018 | Yen et al. | |
| 2004/0075521 | A1* | 4/2004 | Yu | H01F 5/003 336/200 |
| 2004/0178875 | A1* | 9/2004 | Saito | G01R 19/2513 336/200 |

OTHER PUBLICATIONS

Search Report issued in TIPO Office Action dated Jan. 11, 2019 in Taiwan application (No. 107137275).
CN Office Action dated Dec. 24, 2020 in Chinese application (No. 201811288052.8).

* cited by examiner

HIGH ISOLATION INTEGRATED INDUCTOR AND METHOD THEROF

BACKGROUND OF THE DISCLOSURE

Field of the Disclosure

The present disclosure generally relates to inductors and more particularly inductors integrated in an integrated circuit with good magnetic isolation.

Description of Related Art

As is well known by persons skilled in the art, inductors are widely used in many applications. A recent trend is to include a plurality of inductors on a single chip of integrated circuits. An important design issue of when implementing multiple inductors on a single chip of integrated circuits is the reduction of undesired magnetic coupling among the multiple inductors, which is detrimental to a function of the inductors or the integrated circuit. To alleviate the undesired magnetic coupling among multiple inductors, a sufficiently large physical separation between any of two inductors is often needed. This typically results in an enlarged total area of the integrated circuit, which is undesired.

According, what is desired is a method for constructing an inductor that is inherently less susceptible to a magnetic coupling with other inductors fabricated on the same chip of integrated circuits.

SUMMARY OF THE DISCLOSURE

In an embodiment, a device comprises: a first spiral coil laid out on a first metal layer of a multi-layer structure, the first spiral coil spiraling inward from a first end to a second end in a clockwise direction; a second spiral coil laid out on the first metal layer, the second spiral coil spiraling outward from a third end to a fourth end in a counterclockwise direction, wherein the first spiral coil and the second spiral coil are substantially symmetrical with respect to a central line perpendicular to the multi-layer structure; a twin-spiral coil laid out on a second metal layer of the multi-layer structure, the twin-spiral coil spiraling outward from a fifth end to the central line in a clockwise direction and then spiraling inward from the central line to a sixth end in a counterclockwise direction, wherein the twin-spiral coil is substantially symmetrical with respect to the central line; a first via configured to electrically connect the second end to the fifth end; and a second via configured to electrically connect the third end to the sixth end.

In an embodiment, a method includes the following steps: deploying a first spiral coil on a first metal layer of a multi-layer structure, the first spiral coil spiraling inward from a first end to a second end in a clockwise direction; deploying a second spiral coil on the first metal layer, the second spiral coil spiraling outward from a third end to a fourth end in a counterclockwise direction, wherein the first spiral coil and the second spiral coil are substantially symmetrical with respect to a central line perpendicular to the multi-layer structure; interposing a first via between the second end on the first metal layer and a fifth end on a second metal layer of the multi-layer structure; interposing a second via between the third end on the first metal layer and a sixth end on the second metal layer; deploying a twin-spiral coil on the second metal layer, the twin-spiral coil spiraling outward from the fifth end to the central line in a clockwise direction and then spiraling inward from the central line to the sixth end in a counterclockwise direction, wherein the twin-spiral coil is substantially symmetrical with respect to the central line.

DETAILED DESCRIPTION OF THIS DISCLOSURE

The present disclosure is related to inductors. While the specification describes several example embodiments of the disclosure considered favorable modes of practicing the invention, it should be understood that the invention can be implemented in many ways and is not limited to the particular examples described below or to the particular manner in which any features of such examples are implemented. In other instances, well-known details are not shown or described to avoid obscuring aspects of the disclosure.

Figure 1:
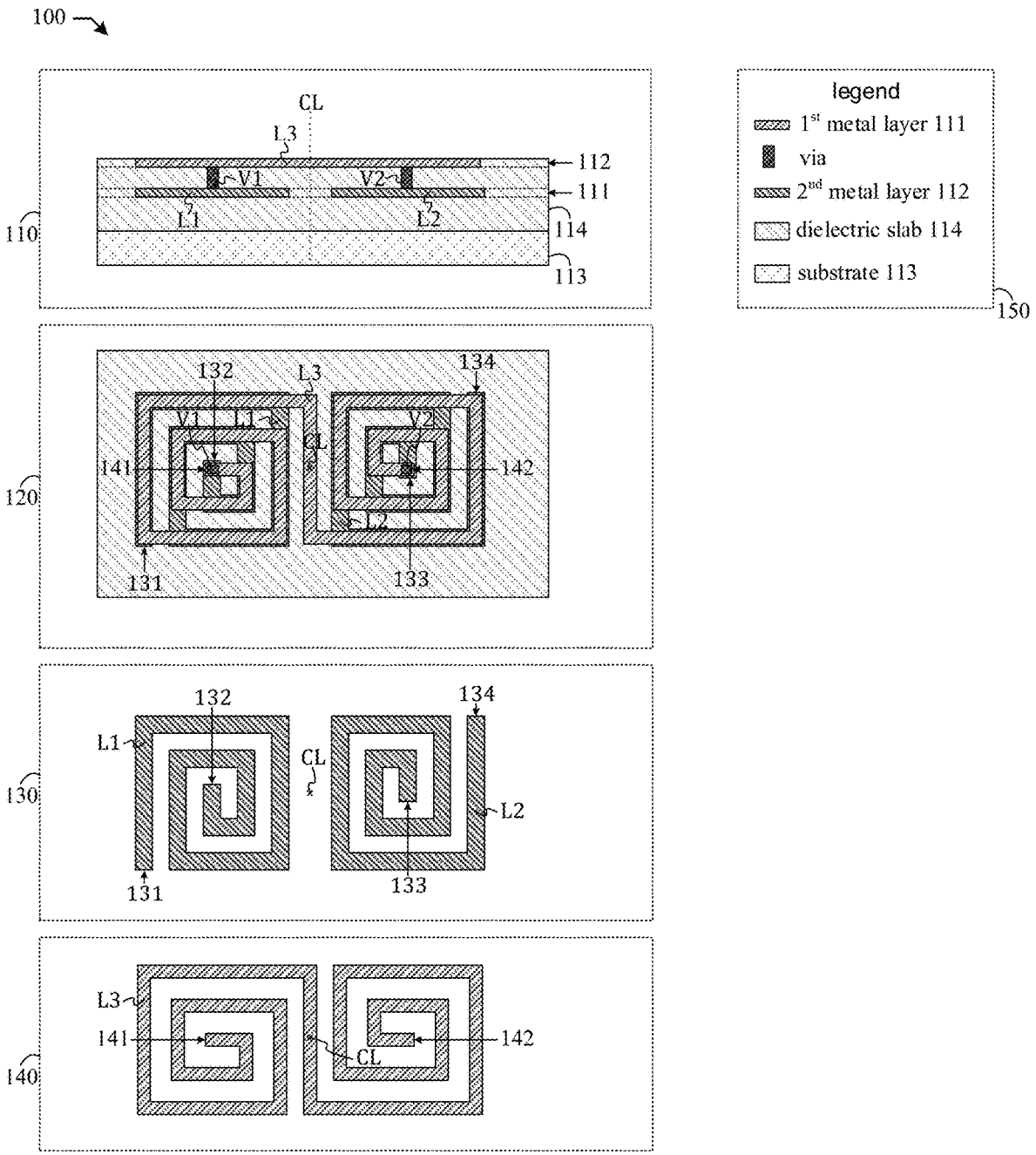
FIG. 1 shows a layout of a device in accordance with an embodiment of the present disclosure.

Reference is made to FIG. 1, which shows a layout of a device 100 from various views in accordance with an embodiment of the present disclosure. The device 100 is of a multi-layer structure. A legend of the layout is shown in box 150. As seen from a cross-sectional view shown in box 110, the device 100 comprises: a substrate 113, a dielectric slab 114 placed on top of the substrate 113, a first spiral coil L1 laid out on a first metal layer 111 housed by the dielectric slab 114, a second spiral coil L2 laid out on the first metal layer 111 housed by the dielectric slab 114, a twin-spiral coil L3 laid out on a second metal layer 112 housed by the dielectric slab 114, a first via V1 configured to connect the first spiral coil L1 with the twin-spiral coil L3, and a second via V2 configured to connect the second spiral coil L2 with the twin-spiral coil L3. As seen from a top view of the first metal layer 111 shown in box 130, the first spiral coil L1 spirals inward from a first end 131 to a second end 132 in a clockwise direction, while the second spiral coil L2 spirals outward from a third end 133 to a fourth end 134 in a counterclockwise direction. The first spiral coil L1 and the second spiral coil L2 are laid out to be substantially symmetrical with respect to a central line CL, which is perpendicular to the multi-layer, and collapses into a single point in a top view. As seen from a top view of the second metal layer 112 shown in box 140, the twin-spiral coil L3 spirals outward from a fifth end 141 to the central line CL in a clockwise direction, then spirals inward from the central line CL to a sixth end 142 in a counterclockwise direction. The twin-spiral coil L3 is laid out to be substantially symmetrical with respect to the central line CL. As seen from a top view shown in box 120, the first via V1 is configured to connect the first spiral coil L1 approximately at the second end 132 and the twin-spiral coil L3 approximately at the fifth end 141, and the second via V2 is configured to connect the second spiral coil L2 approximately at the third end 133 and the twin-spiral coil L3 approximately at the sixth end 142. The first spiral coil L1, the first via, V1, the twin-spiral coil L3, the second via V2, and the second spiral coil L2 jointly form a single inductor with a first terminal at the first end 131 and a second terminal at the fourth end 134.

When a current flows through said single inductor, a magnetic flux generated by the first spiral coil L1 is opposed by a magnetic flex generated by the second spiral coil L2, since they spiral in opposite directions, thus mitigating an undesired magnetic coupling. The twin-spiral inductor L3 has inherently a good magnetic isolation, since a magnetic flux generated by a first half (between the fifth end 141 and the central line CL) is opposed by a magnetic flux generated by a second half (between the central line CL and the sixth end 142). Therefore, the device 100 overall has a good magnetic isolation with other inductors fabricated on substrate 113.

Note that although the central line CL appears to be a point in views in boxes 120, 130, and 140, it is indeed a line that is perpendicular to the multi-layer structure and collapses into a point in a top view. This is apparent from the cross-sectional view in box 110.

Figure 2:
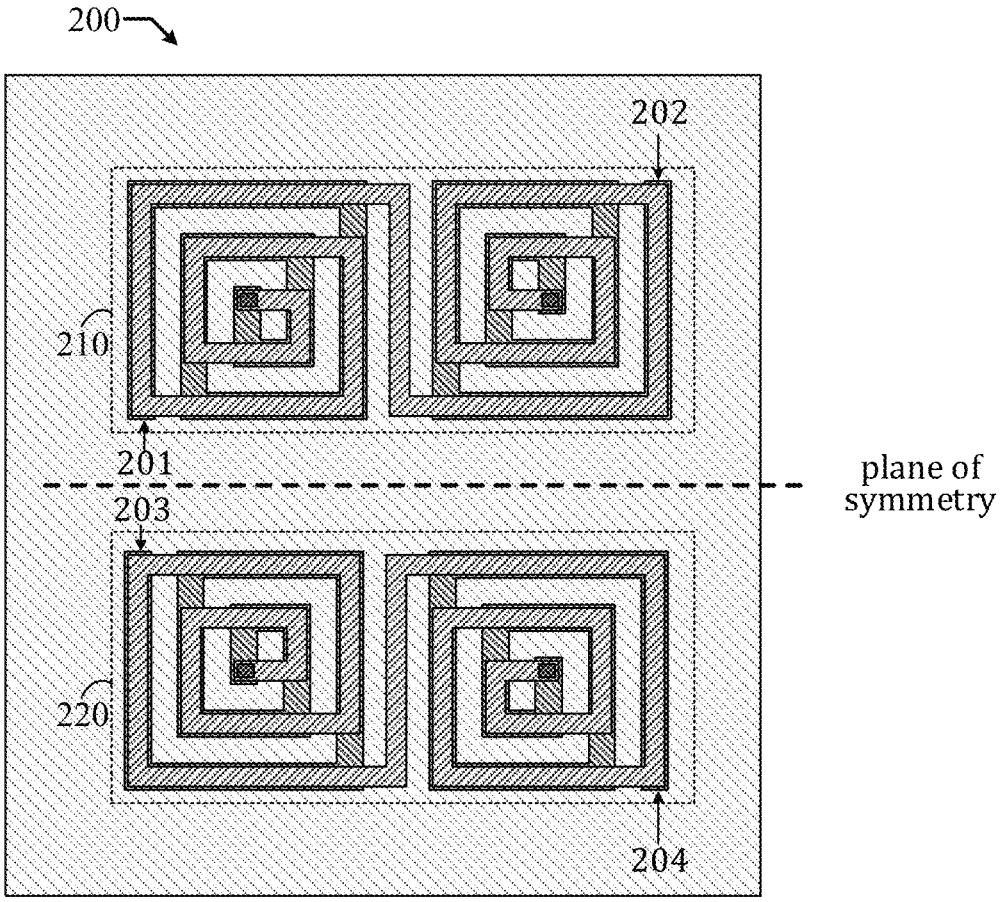
FIG. 2 shows a further embodiment of a layout of a device in accordance with the present disclosure.

In some applications, differential signaling is needed. A top view of an embodiment 200 suitable for a differential signaling application is shown in FIG. 2. Embodiment 200 comprises a first device 210 and a second device 220. The first device 210 is embodied by instantiating the device 100 of FIG. 1. The second device 220 is a mirror image of the first device 210 with respect to a plane of symmetry perpendicular to the multi-layer structure. When a current flows from terminal 201 to terminal 202 of the first device 210, an opposite current flows from terminal 204 to terminal 203 of the second device 220. Both the first device 210 and the second device 220 have a good magnetic isolation, therefore the embodiment 200 also has a good magnetic isolation.

Figure 3:
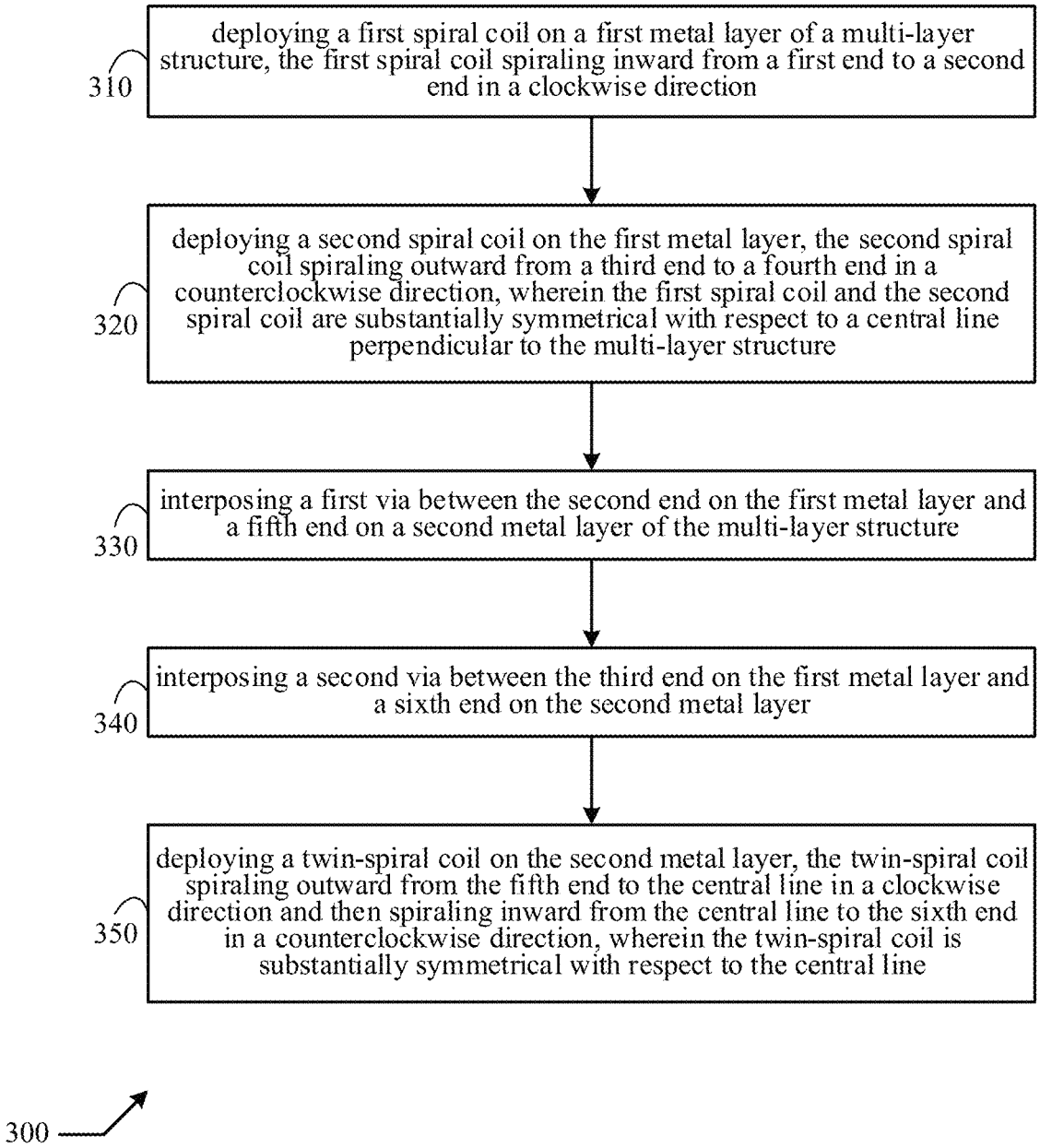
FIG. 3 shows a flow diagram of a method in accordance with an embodiment of the present disclosure.

As depicted in a flow diagram 300 shown in FIG. 3, a method includes the following steps: deploying a first spiral coil on a first metal layer of a multi-layer structure, the first spiral coil spiraling inward from a first end to a second end in a clockwise direction (step 310); deploying a second spiral coil on the first metal layer, the second spiral coil spiraling outward from a third end to a fourth end in a counterclockwise direction, wherein the first spiral coil and the second spiral coil are substantially symmetrical with respect to a central line perpendicular to the multi-layer structure (step 320); interposing a first via between the second end on the first metal layer and a fifth end on a second metal layer of the multi-layer structure (step 330); interposing a second via between the third end on the first metal layer and a sixth end on the second metal layer (step 340); deploying a twin-spiral coil on the second metal layer, the twin-spiral coil spiraling outward from the fifth end to the central line in a clockwise direction and then spiraling inward from the central line to the sixth end in a counterclockwise direction, wherein the twin-spiral coil is substantially symmetrical with respect to the central line (step 350).

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A device comprising:

a first spiral coil laid out on a first metal layer of a multi-layer structure, the first spiral coil spiraling inward from a first end to a second end in a clockwise direction from a first perspective that is perpendicular to the first metal layer;

a second spiral coil laid out on the first metal layer, the second spiral coil spiraling outward from a third end to a fourth end in a counterclockwise direction from the first perspective, wherein the first spiral coil and the second spiral coil are substantially symmetrical with respect to a central line perpendicular to the multi-layer structure;

a twin-spiral coil laid out on a second metal layer of the multi-layer structure, the twin-spiral coil spiraling outward from a fifth end to the central line in a clockwise direction from the first perspective and then spiraling inward from the central line to a sixth end in a counterclockwise direction from the first perspective, wherein the twin-spiral coil is substantially symmetrical with respect to the central line;

a first via configured to electrically connect the second end to the fifth end; and a second via configured to electrically connect the third end to the sixth end;

wherein another device is laid out on the substrate, said another device being a mirror image of the device with respect to a plane of symmetry, the plane of symmetry being perpendicular to the multi-layer structure.

2. The device of claim 1, wherein the multi-layer structure includes a dielectric slab configured to provide a housing for the first metal layer and the second metal layer.

3. The device of claim 2, wherein the dielectric slab is laid out on top of a substrate.

* * * * *